US006676315B1

(12) United States Patent
Haschke

(10) Patent No.: US 6,676,315 B1
(45) Date of Patent: Jan. 13, 2004

(54) PRINTING AND DELIVERY DEVICE FOR LABEL TAGS

(75) Inventor: Eggo Haschke, Deerfield, IL (US)

(73) Assignee: Poly-Clip System GmbH & Co. KG, Frankfurt am Main (DE)

( * ) Notice: Subject to any disclaimer, the term of this patent is extended or adjusted under 35 U.S.C. 154(b) by 0 days.

(21) Appl. No.: 09/869,288

(22) PCT Filed: Jan. 13, 2000

(86) PCT No.: PCT/EP00/00298

§ 371 (c)(1),
(2), (4) Date: Jan. 9, 2002

(87) PCT Pub. No.: WO00/41934

PCT Pub. Date: Jul. 20, 2000

(30) Foreign Application Priority Data

Jan. 14, 1999 (DE) ..... 199 01 039

(51) Int. Cl.[7] ..... B41J 11/36; B41F 1/08

(52) U.S. Cl. ..... 400/617; 400/615.2; 101/288; 101/103; 101/109; 101/328

(58) Field of Search ..... 101/288, 103, 101/104, 109, 316, 319, 320, 327, 328; 400/613, 615.2, 617

(56) References Cited

U.S. PATENT DOCUMENTS 16,718 A * 3/1857 Chamberlin ..... 101/269
1,842,086 A * 1/1932 Hartley ..... 101/269
2,469,299 A * 5/1949 Hatfield ..... 101/288
3,067,677 A * 12/1962 Kask ..... 101/288
3,415,182 A * 12/1968 White ..... 101/68
3,933,092 A * 1/1976 Kirby, Jr. ..... 101/105
4,519,178 A 5/1985 Crabb, Jr. ..... 53/137
5,044,276 A * 9/1991 Huggins ..... 101/292
5,289,666 A 3/1994 Hamilton ..... 53/252
5,300,344 A 4/1994 Niedecker ..... 428/131
5,399,517 A 3/1995 Ashtaputre et al. ..... 437/51

* cited by examiner

*Primary Examiner*—Daniel J. Colilla
*Assistant Examiner*—Jill E. Culler
(74) *Attorney, Agent, or Firm*—Norris McLaughlin & Marcus

(57) ABSTRACT

In a device for printing and delivering semi-rigid tag-type labels (5) to packaging and sealing machines a feed means has a finger (13) translationally moved to and fro, which during the working stroke grasps behind a shoulder of the respective label and advances the same by a defined distance, whereas during the return stroke it glides over the succeeding label until at the end of the return stroke it grasps behind the shoulder of this succeeding label. During the return stroke a printing and embossing roller (15) lifted off during the working stroke is urged against the succeeding label, and the same is inscribed. This ensures that every single tag-type label is correctly printed and delivered for attachment to the object to be labelled.

4 Claims, 3 Drawing Sheets

1
2
3
4
5a
6
7
8
10
11
12
13
14
15
16
17
18
20
21
22

PRINTING AND DELIVERY DEVICE FOR LABEL TAGS

This is a 371 of PCTIEP00/00298 filed Jan. 13, 2000 (international filing date.

This invention relates to a device for printing and delivering semi-rigid labels (tags) to packaging and sealing machines such as sausage clip machines or the like, comprising a feed means for withdrawing a strand of labels from a supply and advancing the strand of labels through a printing station to a delivery station. Such labelling machine for providing webs of fabric with labels clamped onto the edge thereof is known from CH-PS 245 342.

BACKGROUND OF THE INVENTION

It is furthermore known to print self-adhesive labels in connection with automatic label tapes, which are associated to machines for packaging foodstuffs, directly before delivering the labels, in order to attach information as to the expiration of the foodstuff packaged only at the packaging time relevant for the expiration date. For certain foodstuff packages self-adhesive labels are not suited because they do not adhere sufficiently for instance to moist or greasy sausage casings. For these cases it is known to incorporate label tags instead of a self-adhesive label in the means used for sealing for instance sausage ends, i.e. to in particular fix a portion of the tag together with a neck of packaging material at the package by means of a closure clip.

What is problematic in the one as in the other case is the delivery of labels to the respectively used packaging machines. There are commonly used feed rollers which have, however, the disadvantage that a slip between the roller surface and the labels can lead to a misalignment of the labels within the cycle, all the more so as because of the cyclic feed considerable accelerations and decelerations must again and again be handled. This is particularly true for label tags, which must regularly consist of a more rigid material than self-adhesive labels and already for this reason have a higher weight. The necessity of a reliable printing in the course of the delivery of the labels to the sealing machine still aggravates this problem.

From DE 24 17 225 A1 a labelling device for successive hose packages (such as sausages) is known, wherein two labels connected by a connecting thread are each cut of from a label strip and are delivered to a means for sealing adjacent packages such that the connecting thread is seized by the clips sealing on the one hand the end of the leading package and on the other hand the beginning of the succeeding package, and thereupon both the labels and the connecting thread are cut through. The feed is effected by means of a pivotally mounted double-finger arrangement, which during the feed movement grasps behind cuts in the strand of labels and during the return stroke glides over the succeeding labels. However, the labels are completely printed and cannot be provided with actual information such as expiration dates or the like at the moment of processing.

SUMMARY OF THE INVENTION

This problem should be eliminated by means of the invention. In a combined printing and delivery device as stated above it provides on the one hand that the feed means has a finger translationally moving to and fro, which during the working stroke grasps behind a shoulder of the respective label and advances the same by a defined distance, whereas during the return stroke it glides over the succeeding label, until at the end of the return stroke it grasps behind the shoulder of this succeeding label, and on the other hand that a printing and embossing roller lifted off during the working stroke is urged against the succeeding label during the return stroke and inscribes said label. This ensures that each label is exactly printed directly before being delivered to the packaging machine and that it gets into the delivery station.

DETAILED DESCRIPTION

Preferably, the finger has the shape of a two-prong fork which grasps behind two shoulders of the respective label aligned vertical to the feed direction. This stabilizes the translational feed and prevents any canting and thus jamming tendency. In accordance with one embodiment it is provided that during the return stroke a pin extending vertical to the label feed plane biases the succeeding label into the plane of action of the finger or fork. It is basically irrelevant whether for the working stroke the label is raised into the plane of action of the finger or fork or said finger or fork is lowered into the plane of the label. Because of the resilience of the label material it is, however, also possible to leave it at one plane and during the return stroke have the prongs of the fork elastically bend the label on both sides, so that at the end of the return stroke the label completely returns to the plane of the fork. The pin stationarily mounted in the center between the paths of the fork prongs each time urges against the front area of the succeeding label such that it reliably lifts the adjacent shoulders of the label to be fed into the delivery station into the plane of action of the fork prongs and holds them there.

Inscribing is advantageously performed such that the printing and embossing roller urges the label against a stationary printing matrix provided with adjustable sets of characters. Thus, the one stroke of the feeding means is used for advancing the strand of labels and the other stroke (return stroke) is used for printing the succeeding label. Thus, upon termination of one batch only individual labels get lost at best because of a future wrong printing.

BRIEF DESCRIPTION OF THE DRAWINGS

The invention is illustrated in the drawings, wherein.

Figures 1, 2:
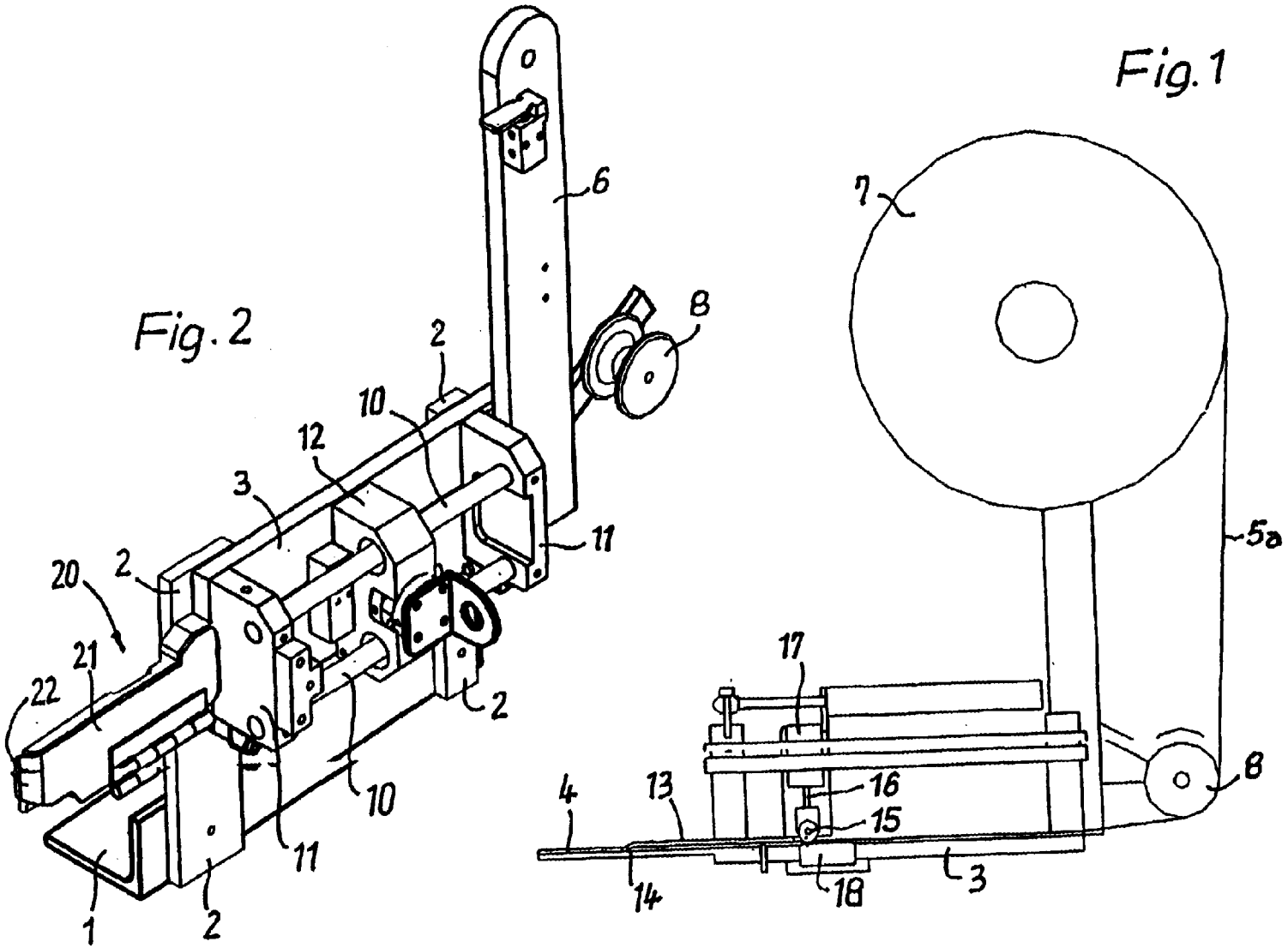
FIG. 1 shows a schematic general drawing of the device in a top view partly tilted into the drawing plane.
FIG. 2 shows a perspective representation of the device without feed roller.

At a bottom angle 1 a vertical table 3 is fixed by means of posts 2, in which table the guideway 4 for a strand of labels 5 is incorporated. To the (rear of the) table 3 a further post 6 is attached, which carries the supply 7 of labels 5 in the form of a roller rotatably mounted on the carrier. The label strand 5*a* runs from the supply 7 via a deflection roller 8 into the guideway 4 of the table 3.

Figure 4:
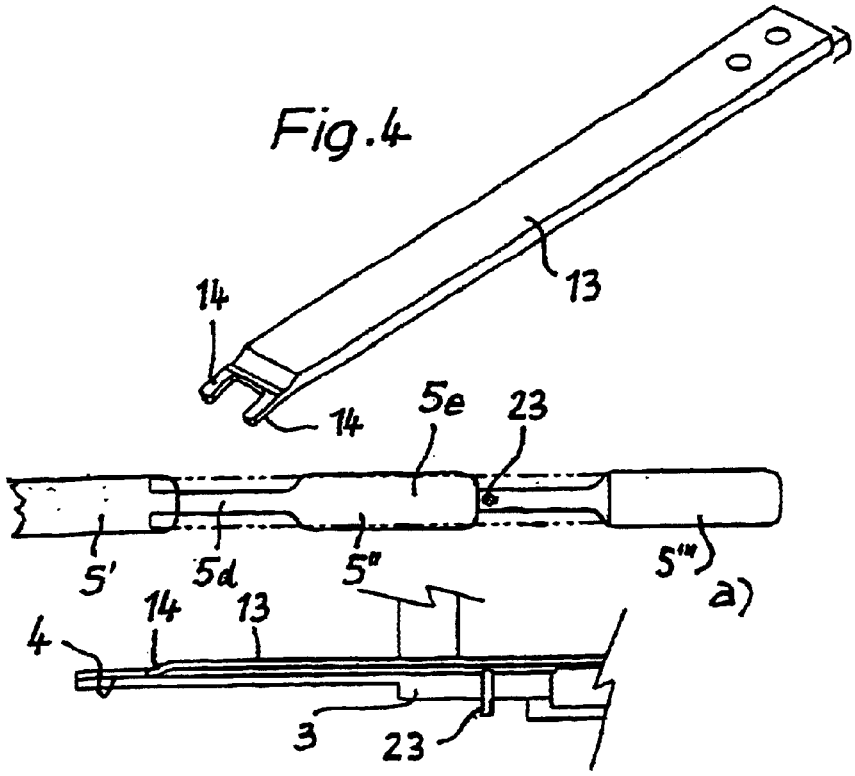
FIG. 4 shows the feeding fork in a perspective representation.

On rods 10, which extend parallel to each other and to the table 3 between holders 11, a carriage 12 is mounted so as to be translationally movable between the holders 11. A pneumatic piston/cylinder unit not represented in detail cyclically moves the carriage 12 to and fro between the holders To the carriage 12, there is on the one hand attached a fork 13 effecting the feed of labels, the cranked prongs 14 of which fork protruding into the guideway 4 in the table 3 (FIG. 4). On the other hand, a contact roller 15 (printing or embossing roller) is mounted on the carriage 12, namely such that by means of a piston rod 16 and another pneumatic piston/cylinder unit 17 it can be urged against the labels present in the feed path 4 or can be lifted off the same (FIG. 1).

Figure 3:
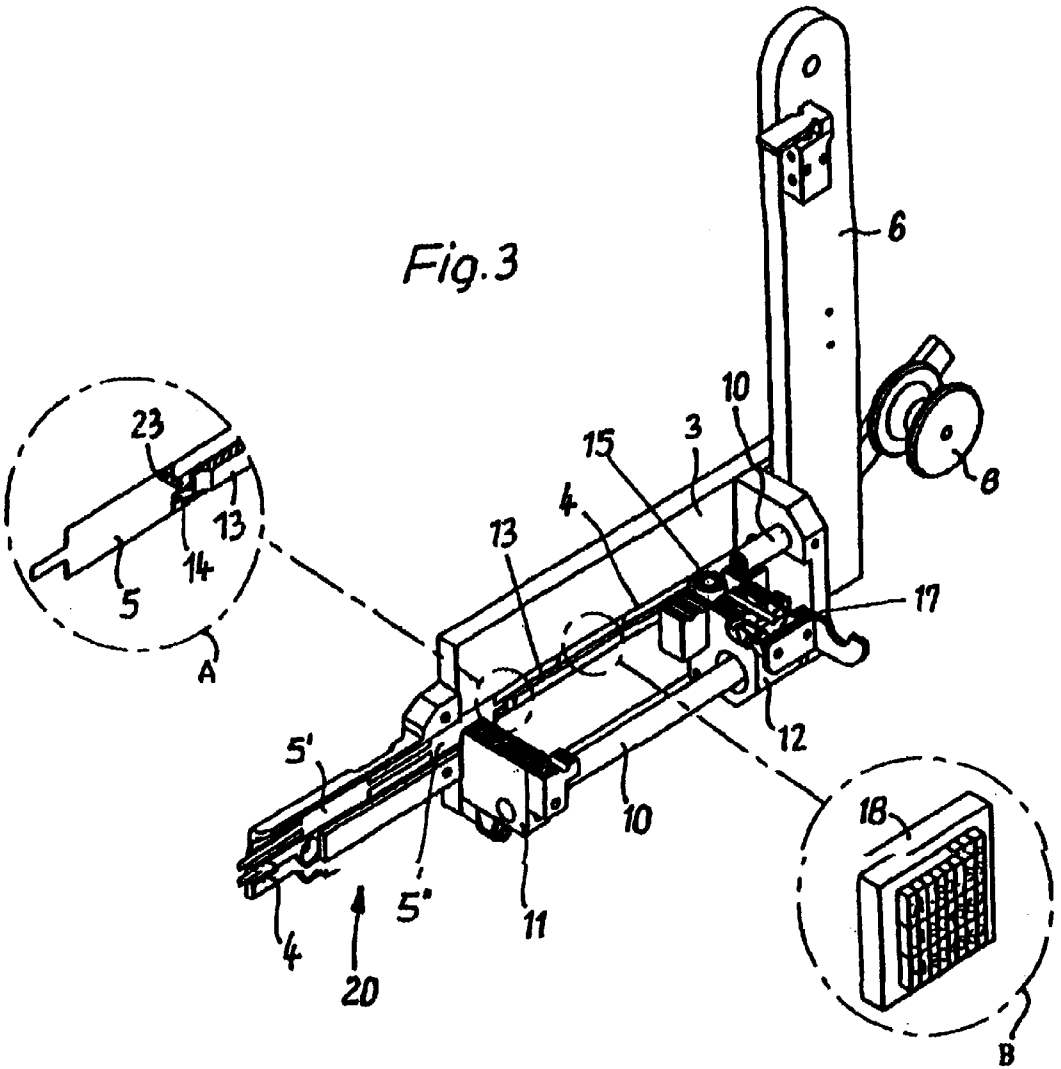
FIG. 3 shows a perspective view similar to FIG. 2, where parts of the device have been omitted or cut away.

On about half the feed path of the carriage 12 between the holders 11 to the rear of the table 4 a printing unit 18 with adjustable sets of characters is provided, which through an opening in the guideway 4, which opening is not represented, but indicated in FIG. 3, prints the desired inscription onto the label 5 present there in the ready position, when during the return stroke of the carriage 12 (towards the supply 7) the label is urged from the roller 15 against the printing unit 18.

In feed direction subsequent to the table 3 a front part 20 is attached, which prolongs the guideway 4 and accommodates labels 5 when they are advanced from the ready position in the vicinity of the table 3. A tiltable cover 21 (FIG. 2; omitted in FIG. 3) closes the guideway 4 inside the front part 20. At the end of the guideway 4 it has a deflection portion 22, which deflects the respectively foremost label 5 when the same is pushed out, so that it is seized by the processing sealing machine and is torn off the succeeding label by tensile force.

FIG. 3 shows a label 5' in the foremost (delivery) position and behind the same the succeeding label 5" in a transfer position. The fork 13 effecting the feed—just as the carriage 12 moving the fork—is disposed in the rearmost position. Therefore, the cranked prongs 14 of the fork 13 grasp behind shoulders 5*b* of that label 5, which shoulders are formed in that the front portion 5*d* of the label adjoining the rear edge 5*c* is narrower than its succeeding portion 5*e* (rig. 5). Between the rear edge 5*c* and the front portion 5*d* of the subsequent label a predetermined breaking point is provided in the form of a perforation which faciliates tearing off the label 5 that has been transferred to the sealing machine.

Figure 5:
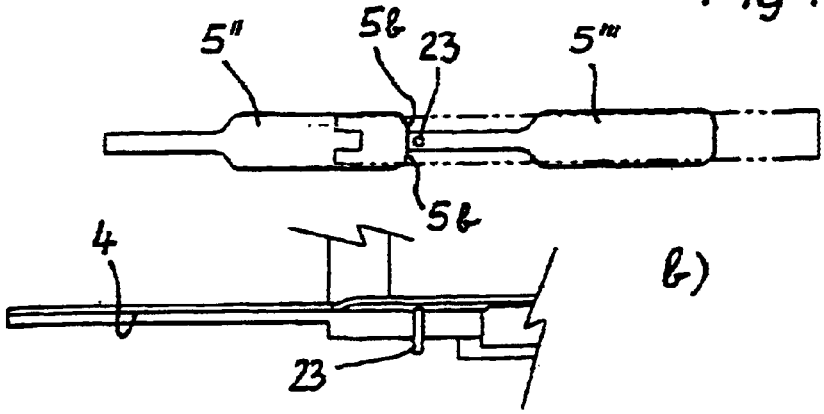
FIG. 5 shows the relative position of the feeding fork and the labels in three difference cycle stages (A–C) in a top view and in a side view.
Figure 5:
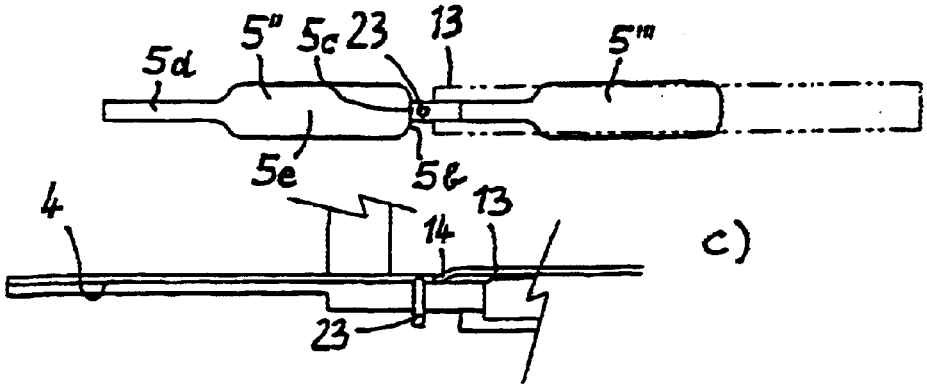

FIG. 5 also illustrates the course of the feed of labels in the guideway 4 of the table 3. In the representation as shown in FIG. 5*a* a feeding stroke has just been terminated, where the fork 13 with its prongs 14 had grasped behind the shoulders 5*b* of the foremost (partly cut away) label 5' and had pushed from right to left—in the drawing. The second Label 5" is in the transfer position, whereas the third label 5" is in the ready position and during the following return stroke is printed in the manner described above.

This (half) return stroke position is shown in FIG. 5*b*. The fork 13—only indicated in dash-dotted lines as in the remaining partial figures of this drawing—glides back over the label 5", slightly bending it off on both sides (which is not represented). However, a pin 23 rests against the bottom surface of the front area of the front label portion 5*d* and urges the same towards the fork such that it is ensured that upon reaching the fully retracted position of the fork 13 represented in FIG. 5*c* the label 5" is also kept ready in the feed path 4 such that during another feeding stroke of the fork 13 (to the left in FIG. 5*c*) the prongs 14 of the fork 13 again safely grasp below or behind the shoulders 5*b* of the label 5" and advance the same from the transfer position into the delivery position.

What is claimed is:

1. A device for printing and delivering semi-rigid labels to packaging and sealing machines, comprising a feeder for withdrawing a strand of labels from a supply and advancing the strand of labels through a printing station to a delivery station wherein said feeder has at least one finger translationally moved to and fro, which during a working stroke grasps behind a shoulder of a respective label and advances the same by a defined distance, whereas during a return stroke it glides over the succeeding label of the strand, until at the end of the return stroke it grasps behind the shoulder of said succeeding label, and wherein a printing or embossing roller lifted off during the working stroke is urged against said succeeding label during the return stroke and urges it against a stationary printing matrix provided with adjustable sets of characters to inscribe said succeeding label.

2. The device as claimed in claim 1, wherein the finger has the shape of a two-prong fork, which grasps behind two shoulders of the respective label.

3. The device as claimed in claim 1, further comprising a guide at the outlet end of the feed path which deflects the front portion of the label.

4. A device for printing and delivering semi-rigid labels to packaging and sealing machines, comprising a feeder for withdrawing a strand of labels from a supply and advancing the strand of labels through a printing station to a delivery station wherein said feeder has at least one finger translationally moved to and fro, which during a working stroke grasps behind a shoulder of a respective label and advances the same by a defined distance, whereas during a return stroke it glides over the succeeding label of the strand, until at the end of the return stroke it grasps behind the shoulder of said succeeding label, and wherein a printing or embossing roller lifted off during the working stroke is urged against said succeeding label during the return stroke and urges it against a stationary printing matrix provided with adjustable sets of characters to inscribe said succeeding label, wherein during the return stroke of the finger a pin biases the succeeding label into the plane of action of the finger or fork.

* * * * *

UNITED STATES PATENT AND TRADEMARK OFFICE

CERTIFICATE OF CORRECTION

PATENT NO. : 6,676,315 B1
DATED : January 13, 2004
INVENTOR(S) : Eggo Haschke

It is certified that error appears in the above-identified patent and that said Letters Patent is hereby corrected as shown below:

Column 1,
Line 5, "(international filing date." should read -- international filing date). --.
Line 45, "cut of from" should read -- cutt off from --.

Column 2,
Line 67, "holders To" should read -- holders 11. To --

Column 3,
Line 36, "(rig. 5)" should read -- (Fig. 5) --.

Signed and Sealed this

Thirteenth Day of July, 2004

JON W. DUDAS
*Acting Director of the United States Patent and Trademark Office*